US008065811B2

(12) United States Patent
Harrison

(10) Patent No.: US 8,065,811 B2
(45) Date of Patent: Nov. 29, 2011

(54) ONE MAN HIGH WALL PENETRATION MEASUREMENT TRANSFER TOOL

(76) Inventor: Kenneth Harrison, Cotati, CA (US)

( * ) Notice: Subject to any disclaimer, the term of this patent is extended or adjusted under 35 U.S.C. 154(b) by 174 days.

(21) Appl. No.: 12/550,531

(22) Filed: Aug. 31, 2009

(65) Prior Publication Data

US 2011/0047806 A1 Mar. 3, 2011

(51) Int. Cl.
*B25H 7/00* (2006.01)
*E04F 21/18* (2006.01)

(52) U.S. Cl. ..... 33/528; 33/DIG. 10

(58) Field of Classification Search ..... 33/32.1, 33/32.2, 194, 526, 528, 529, 613, DIG. 10
See application file for complete search history.

(56) References Cited

U.S. PATENT DOCUMENTS

| | | | | | |
|---|---|---|---|---|---|
| 2,919,913 | A * | 1/1960 | Phair | 269/50 |
| 3,522,658 | A * | 8/1970 | Howell | 33/528 |
| 3,842,510 | A * | 10/1974 | Elliott | 33/528 |
| 3,875,669 | A * | 4/1975 | Hull | 33/528 |
| 4,285,135 | A * | 8/1981 | Minozzi, Jr. | 33/528 |
| 4,423,555 | A * | 1/1984 | Wootten | 33/571 |
| 4,707,925 | A * | 11/1987 | Englehart | 33/194 |
| 5,361,509 | A * | 11/1994 | Wheeler et al. | 33/528 |
| 5,692,357 | A * | 12/1997 | McCain | 52/749.1 |
| 6,282,852 | B1 * | 9/2001 | Walcker | 52/212 |
| 7,363,720 | B2 * | 4/2008 | DiGavero et al. | 33/528 |
| 7,434,326 | B2 * | 10/2008 | Gifford | 33/528 |
| 2002/0170189 | A1 * | 11/2002 | Cheatham | 33/194 |

* cited by examiner

*Primary Examiner* — R. A. Smith
(74) *Attorney, Agent, or Firm* — Bay Area Technology Law Group PC

(57) ABSTRACT

A device for locating vertical wall features and for translating those features onto drywall board or sheeting material to be placed onto the vertical wall. The device includes a main body having a top edge and a bottom edge, at least one channel, the at least one channel being substantially perpendicular to the bottom edge. A rail is provided having first and second terminal ends sized to be slidably and selectively retained within the at least one channel and a lock that selectively prevents sliding of the rail within the channel The rail is of a length such that as its first terminal end locates the features, the second terminal end translates the position of those features onto drywall board to be later placed upon the vertical wall proximate the features.

11 Claims, 5 Drawing Sheets

ONE MAN HIGH WALL PENETRATION MEASUREMENT TRANSFER TOOL

TECHNICAL FIELD

The present invention is directed to a device and method for using the device for locating vertical wall penetration features at a height generally accessible only by ladder or scaffold and translating those features to drywall or sheeting material at a lower elevation. Features such as conduits, mechanical penetrations, cutoffs and vent holes which must be cut from drywall or sheeting material when applied to vertical walls expressing those features can be scribed onto drywall or sheeting material at lower elevations and cut at those elevations thus reducing labor cost by reducing the time devoted to the installation process and the risk of injury associated with the installation of drywall or sheeting material at elevations above those readily accessible without the use of a ladder or scaffold to obtain those wall penetration measurements.

BACKGROUND OF THE INVENTION

The application of drywall board or sheeting material to wall framing stud members is a standard element of commercial and residential construction having been carried out for many years Under normal circumstances, the drywall board or sheeting material is applied to wall framing stud members after the insulation, plumbing, heating, air conditioning and electrical connections have been completed. The drywall board or sheeting material is nailed or screwed to wall flaming stud members and later seams are taped and the surface "mudded" which, upon sanding and finishing, creates an interior wall ready for painting or other finishing.

In instances in which a vertical wall is free of conduit or vent openings, the above-described application process is carried out quickly both at floor level and at elevations, the latter requiring ladders and scaffold The drywall or sheeting material is generally applied board-by-board at four foot elevations until the entire vertical wall has been covered. The installation process, however, becomes much more complex when conduits, plumbing and heating penetrations and vent openings are to pass through the to-be applied drywall or sheeting material. Generally, this is accomplished as a two man procedure One man is on a scaffold taking measurements of the penetrations through the wall and calling them out to the man on the floor with the material to be installed at the higher elevations after he marks and cuts out the penetrations. This process is labor intensive because the man on the scaffold must first call out measurements while the man on the floor with the material waits only to then cut out the penetrations in the material to be applied at the higher elevation. After the bottom man cuts the sheet material to be applied at the higher elevation, he passes the material to the man on the scaffold for him to install The man on the bottom then stands and waits for the man on the scaffold to install the material and when the installation is complete, the scaffold is moved and the whole measurement and cutting process starts over again. During this installation process one man is constantly waiting for the other man to complete his work. He is left standing with no constructive work to do until the other man has completed his work.

In order to complete this method of penetration measurement and sheeting material installation a scaffold must be erected according to Federal and O.S.H.A. requirements to obtain the penetration measurements and prepare the material to be installed, and then install the material. This is a two man process. The above described process makes the drywall board or sheeting material installation a tedious time consuming and labor intensive process and one which is fraught with potential injury.

It is thus proposed through the present invention that one can transcribe and cut features such as electrical and mechanical penetrations and sheet cutoffs onto drywall board and sheeting material at proximate floor level without the aid of scaffolding in order to prepare the sheeting material for future installation. These and further objects will be more readily apparent when considering the following disclosure and appended claims.

SUMMARY OF THE INVENTION

The present invention involves a device for locating vertical wall features and for translating said features onto drywall board or sheeting material to be placed onto said vertical wall comprising a main body, said main body having a top edge, a bottom edge and at least one channel, said at least one channel being substantially perpendicular to said bottom edge, a rail having first and second terminal ends sized to be slidably and selectively retained within said at least one channel, a lock for selectively preventing sliding of said rail within said channel, said rail being of a length such that as said first terminal end of said rail locates said features, the second terminal end of said rail translates the position of said features onto drywall board or sheeting material to be later placed upon said vertical wall proximate said features.

The invention further involves a method of locating vertical wall features and for translating said features onto drywall board or sheeting material to be placed onto said vertical wall comprising providing a device, said device comprising a main body, said main body having a top edge, a bottom edge and at least one channel, said at least one channel being substantially perpendicular to said bottom edge, a rail having first and second terminal ends sized to be slidably and selectively retained within said at least one channel, a lock for selectively preventing sliding of said rail within said channel, said rail being of a length such that as said first terminal end of said rail locates said features, the second terminal end of said rail translates the position of said features onto drywall board and sheeting material to be later placed upon said vertical wall proximate said features, applying said main body to said vertical wall, extending said rail until said first terminal end is positioned at an edge of one of said vertical wall features and translating said position at a location established by the second terminal end of said rail.

This device includes clips that insert into ends of sliding rails that locate top measurements of penetrations and accessories to enable location of tool placement for selective measurement requirements and installation and adjustable attachments for complex measurement conditions.

DETAILED DESCRIPTION OF THE INVENTION

Figure 1:
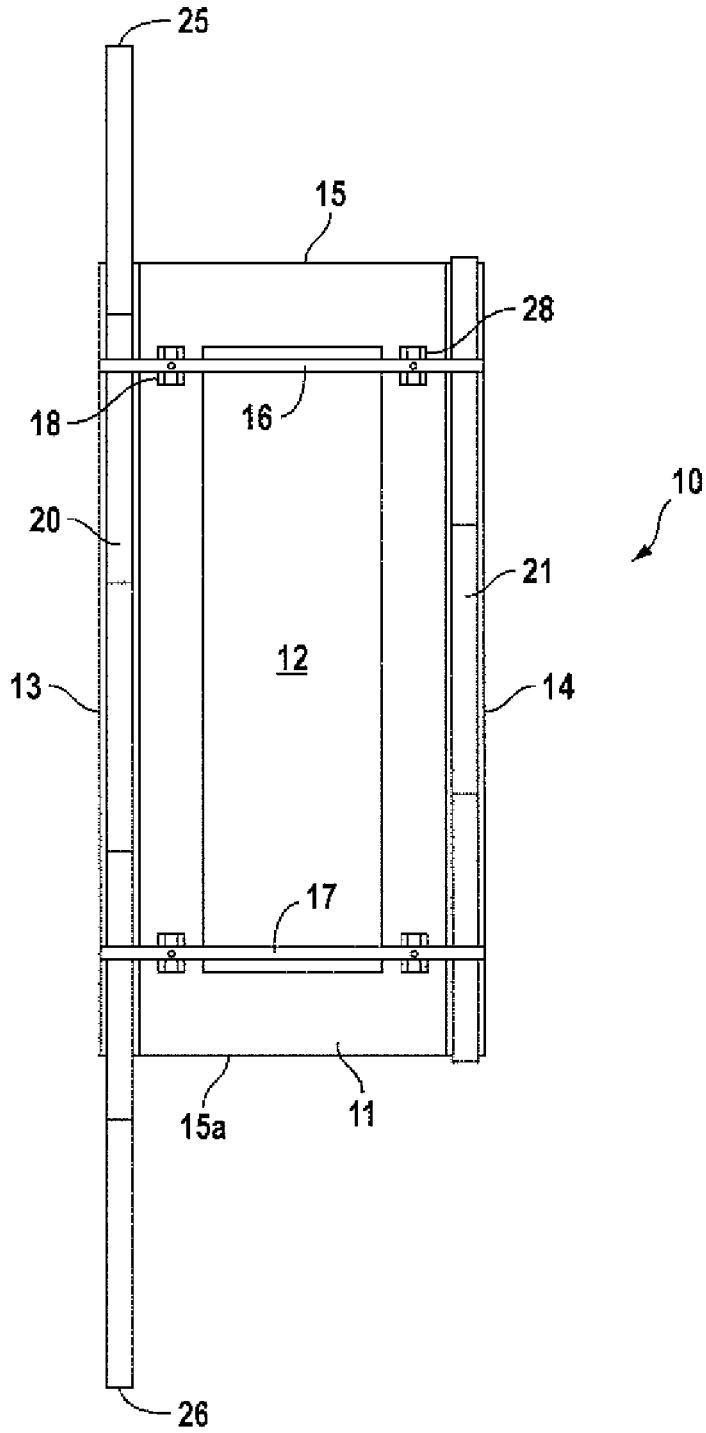
FIG. 1 is a top plan view of the device of the present invention

The device of the present invention can best be appreciated by reference to FIG. 1. Specifically, device 10 configured for locating vertical wall features and for translating those features onto drywall board or sheeting material comprises main body 11 which can optionally be configured with opening 12 to reduce the mass of device 10 Main body 11 is configured with a top edge 15 and bottom edge 15*a* and at least one channel 13 although the embodiment shown in FIG. 1 is configured with channels 13 and 14, the purpose of the latter channel being discussed below.

Figure 5:
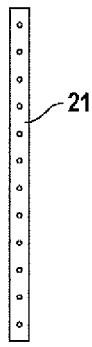
FIG. 5 depicts selective measurement location tool adaptor.

An important design consideration of the present invention is that channel 13 be perpendicular to bottom edge 15*a* so that once bottom edge 15*a* is secured to a horizontal ledge or lip, rail 20 is selectively slidable within channel 13 and moves in a substantially vertical orientation Rail 20 can be provided with extension pieces 21 (FIG. 5) in single or multiple lengths (not shown) to adjust its length as needed. These extension pieces can be stored in channel 14.

Rail 20 is provided with terminal ends 25 and 26 and, as noted above, is to be slidable and selectively retained within channel 13. Ideally, rail 20 can be fixed within channel 13 by using one of a number of simple locking devices for this purpose. One such device is illustrated in FIGS. 2*a* and 2*b*.

Figure 2A:
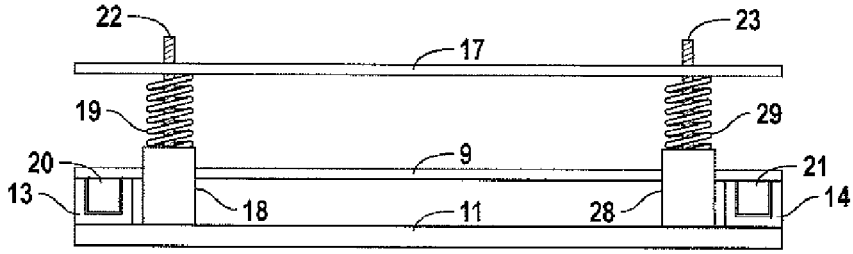
FIGS. 2*a* and 2*b* are side views of the device depicted in FIG. 1.
Figure 2B:
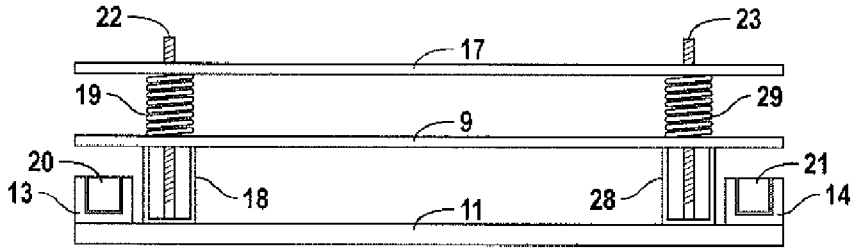

Turning to FIG. 2*a*, retaining bar 9 is biased against rail 20 within channel 13 by virtue of helical springs 19 and 29. Handle 17 remains fixed on uprights 22 and 23 which are fixed to body 11 of device 10. A person using the tool when wishing to enable rail 20 to freely slide within channel 13 can grip handle 17 and locking bar 9 by pulling them together with one's thumb and fingers compressing helical springs 19 and 29. Upon doing so, U-shaped brackets 18 and 28 can be moved upwardly and rotated 90 degrees into the locking orientation shown in FIG. 2*b*. At that point, rail 20 can freely slide within channel 13. When one wishes to lock rail 20 within channel 13, U-shaped members 18 and 28 can be rotated to their FIG. 2*a* orientation which enables bar 9 to lower closer to body 11 of device 10 enabling helical springs 19 and 29 expand. This fixes rail 20 as required.

As noted above, it is the intent of the present invention to enable a drywall or sheeting material installer to measure and cut drywall board or sheeting material to accommodate various features such as conduit opening 31 and vent opening 32 and without the use of the present invention, require the multi-step process of erecting a scaffold, using two employees (one on the scaffold and one on the existing floor), measuring and verbally transferring the wall penetrations and cutoffs from the man at the higher elevation to the man at the lower elevation, cutting and preparing the material to be installed by the man at the lower elevation, and the removal and the relocation of the scaffold necessary to complete this process. This multi-step process is time consuming and labor intensive and will be reduced when employing the device disclosed herein. In some conditions the final prepared product could be installed with the use of a ladder by a single employee.

Figure 3A:
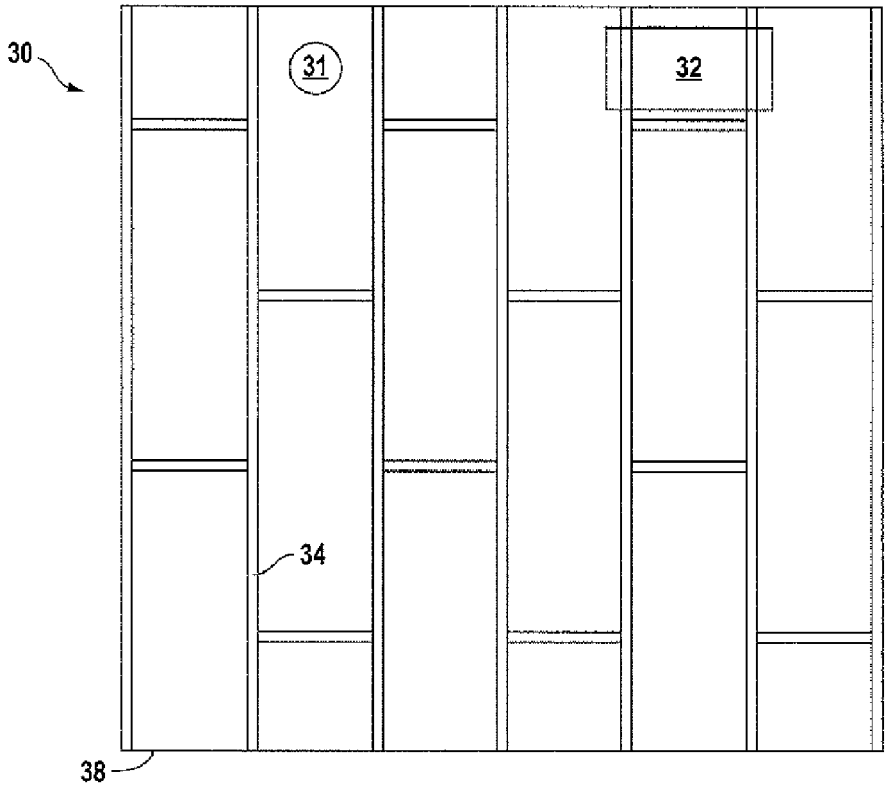
FIGS. 3*a* through 3*e* and 3*g* illustrate side plan views of walls for showing the steps of the method of using the present invention

In this regard, reference is made to FIGS. 3*a* through 3*g* Turning first to FIG. 3*a*, a typical wall with no drywall or sheeting material applied is depicted having stud members 34 exposed. This area 30 includes floor 38 and conduit opening 31 and vent opening 32, each of which must be accommodated by configuring holes in the drywall board or sheeting material to be placed thereon. It is noted that these features can be found typically at elevations which would require a ladder or scaffolding to reach in order to obtain the wall penetration measurements. By way of examples, conduit opening 31 and vent opening 32 could be 8 to 16 feet above the level of flooring 38.

Figure 3B:
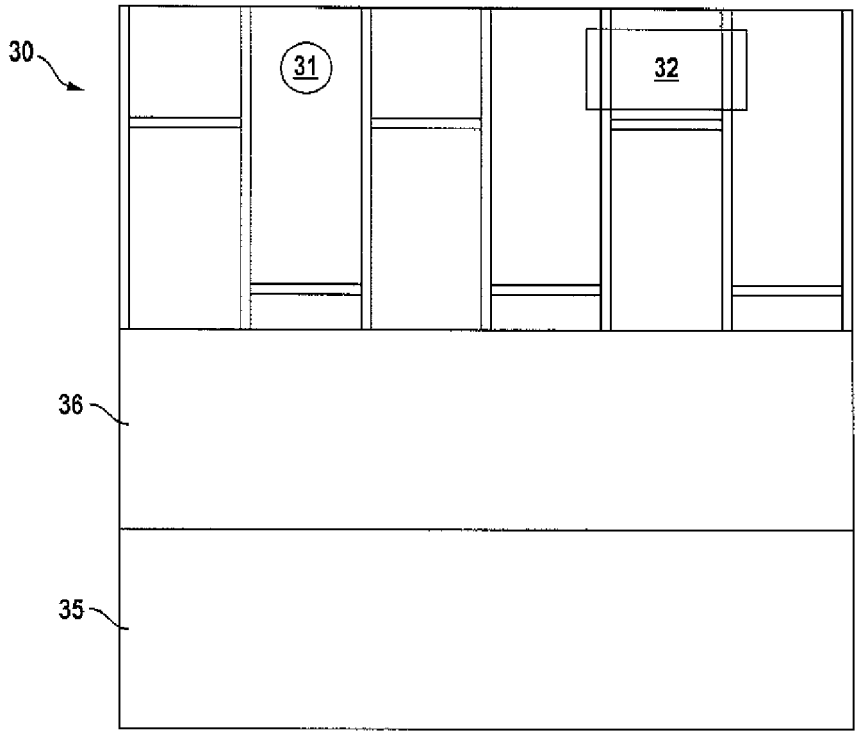
Figure 3C:
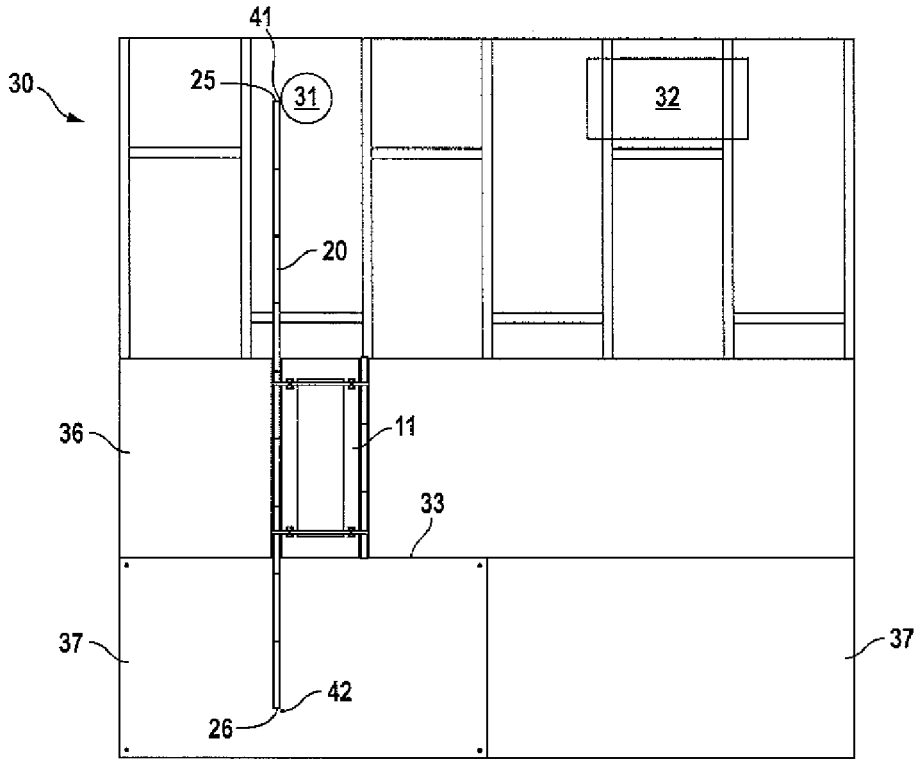

In turning to FIG. 3*b*, the first step in the operation is to apply, per usual practice, drywall board or sheeting material 35 and 36 at lower elevations. Wallboard and sheeting materials are typically employed in 4×8 foot sections so that the top of wall board 36 would be 8 feet above floor level The next step in the operation is to lightly tack a second layer of material identified as drywall board 37 in front of drywall board 35 (FIG. 3*c*). This establishes upper edge 33 as a lip or ledge in front of drywall board 36. Ledge 33 should be established as being substantially horizontal and receives bottom edge 15*a* of device 10 In operation, one can press body section 11 against drywall board 36 moving back and forth across lip or ledge 33 using rail 20 to establish the measurements of the elevated wall penetrations.

Figure 3D:
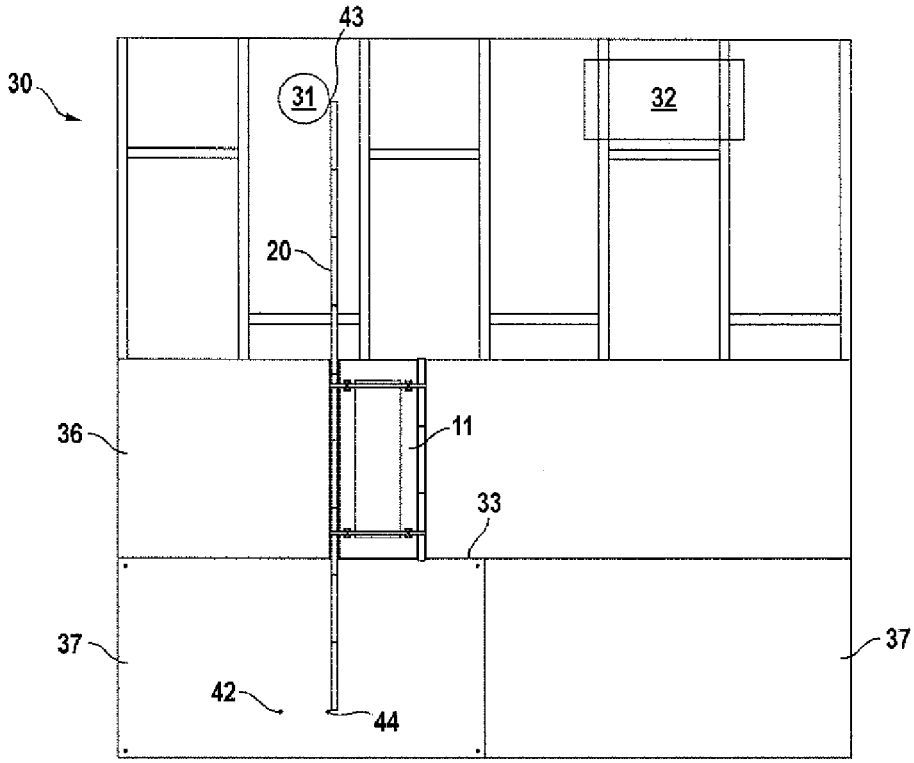
Figure 3E:
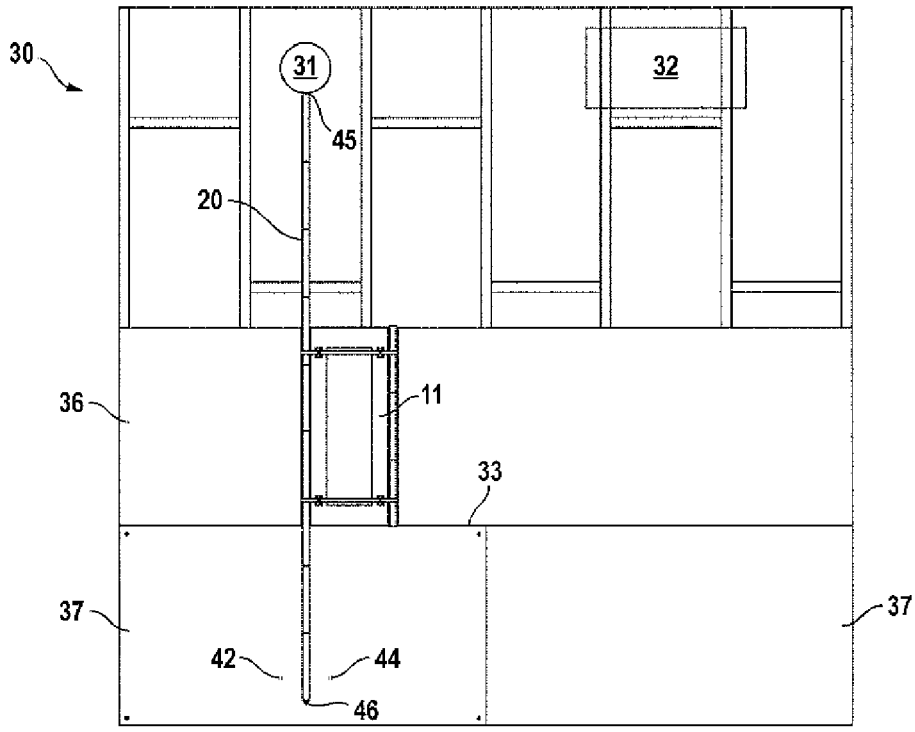
Figure 3F:
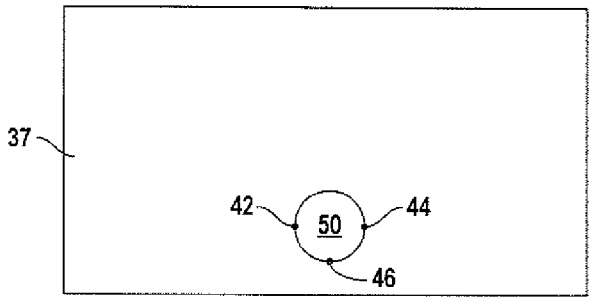
FIG. 3*f* depicts drywall board or sheeting material fabricate by using the method as illustrated in FIGS. 3*a* through 3*e* and 3*g*.

By way of example, the present device is employed to establish the size and position of conduit opening 31 without having to climb to conduit 31's elevated position. This is done by placing body 11 of device 10 in front of drywall board 36 onto edge 33 as shown in FIG. 3*c*. First terminal end 25 of rail 20 is then placed at one side of the circumference of conduit opening 31 at tangency of point 41 Rail 20 is sized such that second terminal end 26 is positioned upon drywall board 37 to establish point 42 This is the measurement location for one side of the conduit. Device 10 is then moved on lip 33 to opposite side of conduit opening 31 and rail 20 transfers the measurement location of the second side of conduit 31 to the drywall board 37 at point 44. The corresponding side of rail 20 (points 42 and 44) are marked on the lower drywall or sheeting material 37 as shown in FIG. 3*c* and FIG. 3*d*. As shown in FIG. 3*e*, device 10 is moved to position rail 20 under conduit 31 thereby establishing the bottom edge 45 of the conduit 31 on drywall board 37 at point 46 and with the three points established the size of the penetration cutout for conduit 31 is fixed. Opening 50 is then scribed (FIG. 3*f*)

Although not shown, drywall board 37 can then be placed at an elevated position onto wall 30 in an area occupied by conduit opening 31 as accommodating conduit opening 31 through opening 50 therein without having to employ the labor intensive two man process of taking and transferring measurements and cutoffs from a scaffold to the floor level in order to prepare the material for the installation process.

Figure 3G:
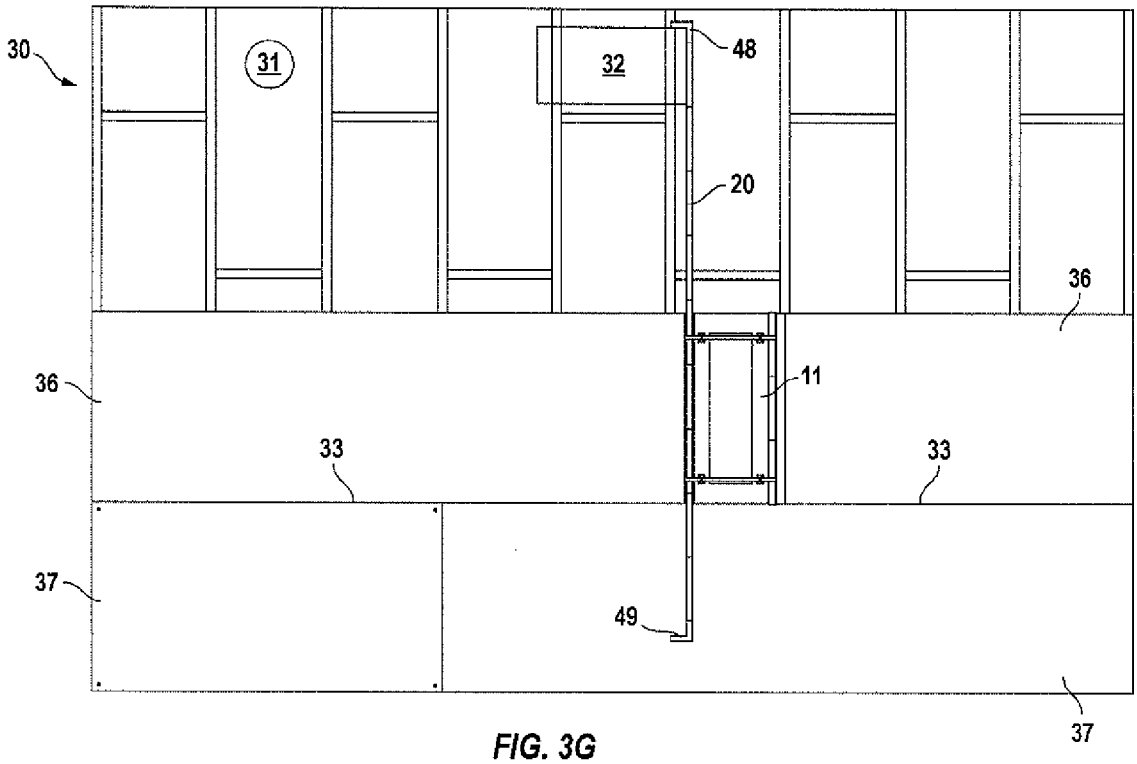

The same method of using the present device can be carried out in providing an opening in drywall board or sheeting material for any feature including vent opening 32 shown on sheet FIG. 3*g*. One would merely place a corresponding drywall board to current drywall board 37 below vent opening 32 and would go through the process of establishing enough dimensional positions such as the bottom, top and sides of vent opening 32 scribed onto drywall board to later be cut and directly installed in the vicinity of vent opening 32.

Figure 4:
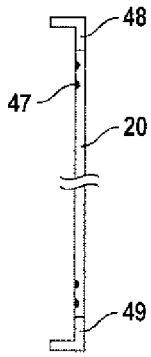
FIG. 4 is a side view of a preferred embodiment of a slidable rail section for use in the device of FIG. 1 and in carrying out the method of FIGS. 3*a* through 3*e*.

On occasion, particular in dealing with square or rectangular openings, it is helpful to provide L-shaped brackets 48 and 49 as illustrated in FIG. 4 in order to locate the top of penetrations These brackets each have a first leg which extends within rail 20 and a second leg extending substantially perpendicularly therefrom. These L-shaped brackets can be selectively removed held in place through the use of spring loaded button features selectively entering into openings 47 within rails 20. In other words, L-shaped brackets 48, 49 attached to rail 20 are for locating the top measurement of penetrations shown in FIG. 3*f* (large mechanical duct opening). Rail 20 is moved until clip 48 on rail 20 is resting on penetration 32 establishing the measurement location of the top of the penetration The device 10 can be rotated 180 degrees so the top clip 49 on rail 20 can locate and transfer the opposite (left) side of the top measurement penetration on the duct location 32 to the bottom clip 48.

Upon consideration of the above disclosure, it should become readily apparent that through the use of what amounts to relatively simple yet elegant device, one is able to scribe and cut openings in drywall board and sheeting material at relatively low elevations thus minimizing the need to erect a scaffold and engage the two man process of measuring, cutting and installation of the drywall or sheet material. In addition, what has traditionally been a two man operation can be done with a single worker. The necessary penetration openings are made at ground level and installation at elevated positions can be accomplished in the way where installation time is reduced and the time consuming transferring of measurements and prolonged use of scaffold is reduced to a minimum or completely eliminated, depending on conditions, by one man using a tall ladder for installation of the smaller pieces of the prepared material. Thus, drywall board or sheeting material installation, through the present invention, is much faster, safer and less costly to install than in the past.

What is claimed is:

1. A device for locating vertical wall features and for translating said features onto drywall board or sheeting material to be placed onto said vertical wall comprising a main body, said main body having a top edge, a bottom edge and at least one channel, said at least one channel being substantially perpendicular to said bottom edge, a rail having first and second terminal ends sized to be slidably and selectively retained within said at least one channel, a lock for selectively preventing sliding of said rail within said channel, said rail being of a length such that as said first terminal end of said rail locates said features, the second terminal end of said rail translates the position of said features onto drywall board or sheeting material to be later placed upon said vertical wall proximate said features.

2. The device of claim 1 wherein said lock comprises a spring biased bar positioned to pass over said channel.

3. The device of claim 2 further comprising a handle for lifting and positioning said device.

4. The device of claim 3 wherein said handle comprises a bar extending substantially parallel to said biased bar.

5. The device of claim 1 further comprising a locating fixture for selective retention to said first and second terminal ends of said rail.

6. The device of claim 5 wherein said locating fixture comprises an L-shaped bracket, a first leg of which extends within said rail and a second leg of which extends substantially perpendicularly therefrom.

7. The device of claim 1 wherein said main body comprises a substantially planar member having a front face and rear face, both said front face and rear face being positionable on said vertical wall.

8. The device of claim 1 further comprising a second channel sized to receive said rail.

9. The device of claim 1 further comprising an extension element for increasing the size of said rail.

10. A method of locating vertical wall features and for translating said features onto drywall board or sheeting material to be placed onto said vertical wall comprising providing a device, said device comprising a main body, said main body having a top edge, a bottom edge and at least one channel, said at least one channel being substantially perpendicular to said bottom edge, a rail having first and second terminal ends sized to be slidably and selectively retained within said at least one channel, a lock for selectively preventing sliding of said rail within said channel, said rail being of a length such that as said first terminal end of said rail locates said features, the second terminal end of said rail translates the position of said features onto drywall board to be later placed upon said vertical wall proximate said features, said method steps comprising:

applying said main body to said vertical wall, extending said rail until said first terminal end is positioned at an edge of one of said vertical wall features, and translating said position at a location established by the second terminal end of said rail.

11. A method of locating vertical wall features at a first elevation and for translating said features to drywall board and sheeting material at a second elevation below said first elevation and for positioning said drywall board to said second elevation, said method steps comprising:

applying drywall board proximate said second elevation, said dry wallboard having a substantially horizontal top edge, providing a device, said device comprising a main body, said main body having a top edge, a bottom edge and at least one channel, said at least one channel being substantially perpendicular to said bottom edge, and providing a rail having first and second terminal ends sized to be slidably and selectively retained within said at least one channel, a lock for selectively preventing sliding of said rail within said channel, said rail being of a length such that as said first terminal end of said rail locates said features, the second terminal end of said rail translates the position of said features onto drywall board to be later placed upon said vertical wall proximate said features, positioning said bottom edge of said device upon said top edge of said drywall board, extending said rail until said first terminal end is positioned at an edge of one of said vertical wall features, marking said edge on said drywall board as established by the second terminal end of said rail, cutting said drywall board corresponding to said wall features, and installing said drywall board at said first elevation.

* * * * *